US006514343B1

(12) United States Patent
Motoda

(10) Patent No.: US 6,514,343 B1
(45) Date of Patent: Feb. 4, 2003

(54) COATING APPARATUS

(75) Inventor: Kimio Motoda, Kumamoto-Ken (JP)

(73) Assignee: Tokyo Electron Limited, Tokyo (JP)

( * ) Notice: Subject to any disclaimer, the term of this patent is extended or adjusted under 35 U.S.C. 154(b) by 104 days.

(21) Appl. No.: 09/667,811

(22) Filed: Sep. 22, 2000

(30) Foreign Application Priority Data

Oct. 1, 1999 (JP) ..... 11-281719

(51) Int. Cl.[7] ..... B05B 3/00; B05C 5/00; B05C 11/00

(52) U.S. Cl. ..... 118/323; 118/313; 118/712; 118/713

(58) Field of Search ..... 118/52, 612, 313, 118/712, 713, 323; 427/315, 8, 10

(56) References Cited

U.S. PATENT DOCUMENTS 5,211,753 A * 5/1993 Swain ..... 118/52
5,779,796 A * 7/1998 Tomoeda et al. ..... 118/52
6,068,881 A * 5/2000 Valley et al. ..... 118/52
6,207,231 B1 * 3/2001 Tateyama ..... 118/52

FOREIGN PATENT DOCUMENTS

JP 11-329938 11/1999
JP 2000-77326 3/2000

* cited by examiner

*Primary Examiner*—Richard Crispino
*Assistant Examiner*—Yewebdar T Tadesse
(74) *Attorney, Agent, or Firm*—Rader, Fishman & Grauer PLLC

(57) ABSTRACT

A nozzle provided with a plurality of discharge apertures in line for discharging a resist solution as a coating solution toward a top surface of a substrate G held by a holding plate is provided at a lower portion of a main body of a coating head. The resist solution is simultaneously discharged from the plurality of discharge apertures while the nozzle is scan-moved in a direction orthogonal to an arranging direction of the discharge apertures. With the above configuration, the disadvantage of the coating solution dropping or the like is eliminated, the waste of the coating solution is avoided, and in addition, the time taken to perform coating processing is reduced.

13 Claims, 13 Drawing Sheets

COATING APPARATUS

BACKGROUND OF THE INVENTION

1. Field of the Invention

The present invention belongs to the technical field in which processing is performed for a semiconductor wafer and a glass substrate used in a liquid crystal display, for example, by utilizing the photolithography technology. The invention particularly relates to a coating apparatus for applying a coating solution such as a resist solution or the like onto, for example, a semiconductor wafer and a glass substrate.

2. Description of the Related Art

In a process for fabricating a liquid crystal display device, a series of processing in which a circuit pattern or the like is reduced and exposed and transferred to a photo resist, and developing processing is performed for the same is carried out by using the photolithography technology as used in the semiconductor fabricating process in order to form an ITO thin film, an electrode pattern and the like, for example, on a glass substrate.

The above series of processing is performed by a coating and developing processing system with the configuration in which a cleaning apparatus, an adhesion processing apparatus, a cooling processing apparatus, a resist coating apparatus, a heating processing apparatus, a developing apparatus and the like are disposed along a transfer path on which a transfer device for transferring, for example, a glass substrate can travel. In the coating and developing processing system as above, after a glass substrate is cleaned in the cleaning apparatus, hydrophobic processing is performed for the glass substrate in the adhesion processing apparatus. Subsequently after the glass substrate is cooled in the cooling processing apparatus, coating of a photo resist film is formed thereon. Thereafter, the photo resist film is heated in the heating processing apparatus, thereby performing pre-bake processing, and thereafter it is cooled. A predetermined pattern is exposed in an aligner connected with the system. After a developing solution is applied to the glass substrate after exposure in the developing apparatus, thereby performing developing processing, the developing solution is cleaned therefrom by means of a rinse solution, and post-baking processing is performed, thus completing a series of process.

In the aforementioned resist coating apparatus, a spin coat method, in which a spin chuck is rotated with a glass substrate being placed on, for example, a spin chuck and a resist solution is supplied to the center of rotation, is used. However, when the resist solution is applied by such a spin coat method, the disadvantage, in which a considerable amount of resist solution supplied onto the glass substrate is shaken off to the outside of the glass substrate by centrifugal force and is wasted, arises.

The inventors of the present invention propose the art of applying a resist solution only to the area requiring it as much as possible by scan-moving a nozzle in a tapering form for discharging the resist solution over the top surface of a glass substrate to eliminate the waste of the resist solution.

However, the nozzle with the above configuration has the disadvantage of taking a very long time to apply the resist solution onto the entire surface of the glass substrate since the scanning pitch of the nozzle is small.

Especially when the viscosity of a resist solution is high, or when the contact angle of a glass substrate top surface is large, the spread of the resist solution on the glass substrate top surface becomes small, and therefore the scanning pitch of the nozzle needs to be made smaller, thus taking a longer time to perform coating processing of the resist solution.

Further, if a long time is taken to perform coating processing as above, the drying time of the resist solution at the spot to which it is initially applied to the glass substrate and the drying time of the resist solution at the spot to which it is finally applied considerably differ. Thus the disadvantage of losing uniformity of the film thickness arises.

It can be considered, for example, to increase a radius of a discharge aperture provided at a tip end of the nozzle, but if the radius of the discharge aperture is increased, the disadvantage arises that the resist solution cannot be held inside the nozzle and drops therefrom when the supply of the resist solution from the nozzle is stopped.

SUMMARY OF THE INVENTION

An object of the present invention is to provide a coating apparatus, with which the disadvantage of dropping a coating solution or the like as above does not occur, the waste of the coating solution is eliminated, and the time taken to perform coating processing can be reduced.

In order to attain the above object, according to the viewpoint of the present invention, a coating apparatus comprising a holding member for holding a substrate, a nozzle provided with a plurality of discharge apertures in line for discharging a coating solution toward a top surface of the held substrate, and a scanning mechanism for scan-moving the aforesaid nozzle over the held substrate is provided.

According to the above configuration, the coating solution is discharged from the plurality of discharge apertures at the same time while, for example, the nozzle is scan-moved in the direction orthogonal to the arranging direction of the discharge apertures, thereby making it possible to apply the coating solution onto the substrate with approximately the width of the discharge apertures arranged in line relative to the scanning direction of the nozzle. Consequently, the waste of the coating solution is eliminated, and the time taken to perform coating processing can be reduced. Since it is not necessary to increase the radius of each discharge aperture, the coating solution does not drop.

These objects and still other objects and advantages of the present invention will become apparent upon reading the following specification when taken in conjunction with the accompanying drawings.

DETAILED DESCRIPTION OF THE PREFERRED EMBODIMENT

Preferred embodiments of the present invention will be described based on the drawings.

In the embodiments, a case in which the present invention is applied to a coating and developing processing system for forming a resist film on a glass substrate and developing the glass substrate after exposure is explained.

Figure 1:
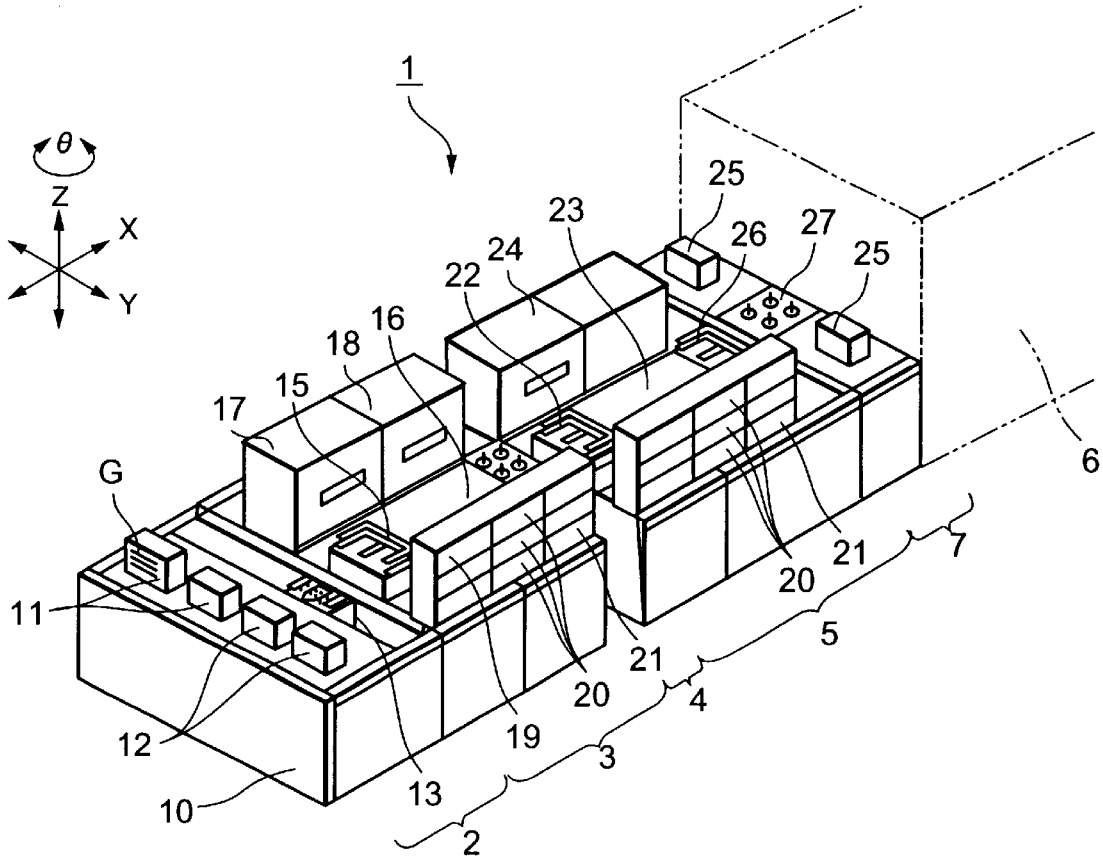
FIG. 1 is a perspective view of a coating and developing processing system according to a first embodiment of the present invention.

FIG. 1 is a perspective view showing a configuration of the coating and developing processing system according to the embodiment.

A coating and developing processing system 1 shown in FIG. 1 is mainly defined by a loader section 2 for carrying in and carrying out a glass substrate G (hereinafter called "a substrate G"), a first processing section 3 for the substrate G, and a second processing section 5 provided connectively to the first processing section 3 via a junction section 4. An aligner 6 for exposing a predetermined fine pattern on a resist film can be provided connectively to the second processing section 5 via a delivery section 7.

The aforementioned loader section 2 is provided with a cassette station 10 on which a plurality of cassettes 11 for housing the unprocessed substrates G and a plurality of cassettes 12 for housing the processed substrates G can be placed. Substrate carrying in/out tweezers 13, which are movable in the horizontal (X, Y) and the vertical (Z) direction and rotatable in a (θ) direction is included to carry in and out the substrate G from and to the cassettes 10 and 11.

In the first processing section 3, a brush cleaning device 17 for brush-cleaning the substrate G and a developing device 18 are disposed side by side at one side of a transfer path 16 on which a main substrate transfer device 15 movable in the X, Y and Z direction and rotatable in the θ direction can travel, while an adhesion processing device 19 for performing hydrophobic processing for the top surface of the substrate G, a heat processing device 20 for performing post-baking to heat the substrate G after the developing processing and a cooling processing device 21 for cooling the substrate G to a predetermined temperature are multi-tiered at the other side of the transfer path 16.

In the second processing section 5, as in the first processing section 3, a coating device 24 is disposed at one side of a transfer path 23 on which a main substrate transfer device 22 movable in the X, Y and Z direction and rotatable in the θ direction can travel, while a heat processing device 20 for performing pre-baking to heat the substrate G after applying the resist solution and a cooling processing device 21 are multi-tiered at the other side of the transfer path 23.

The transfer section 7 is provided with a cassette 25 for making the substrate G wait temporally, transfer tweezers 26 for carrying in and out the substrate G from and to the cassette 25 and a delivery table 27 for the substrate G.

Figure 2:
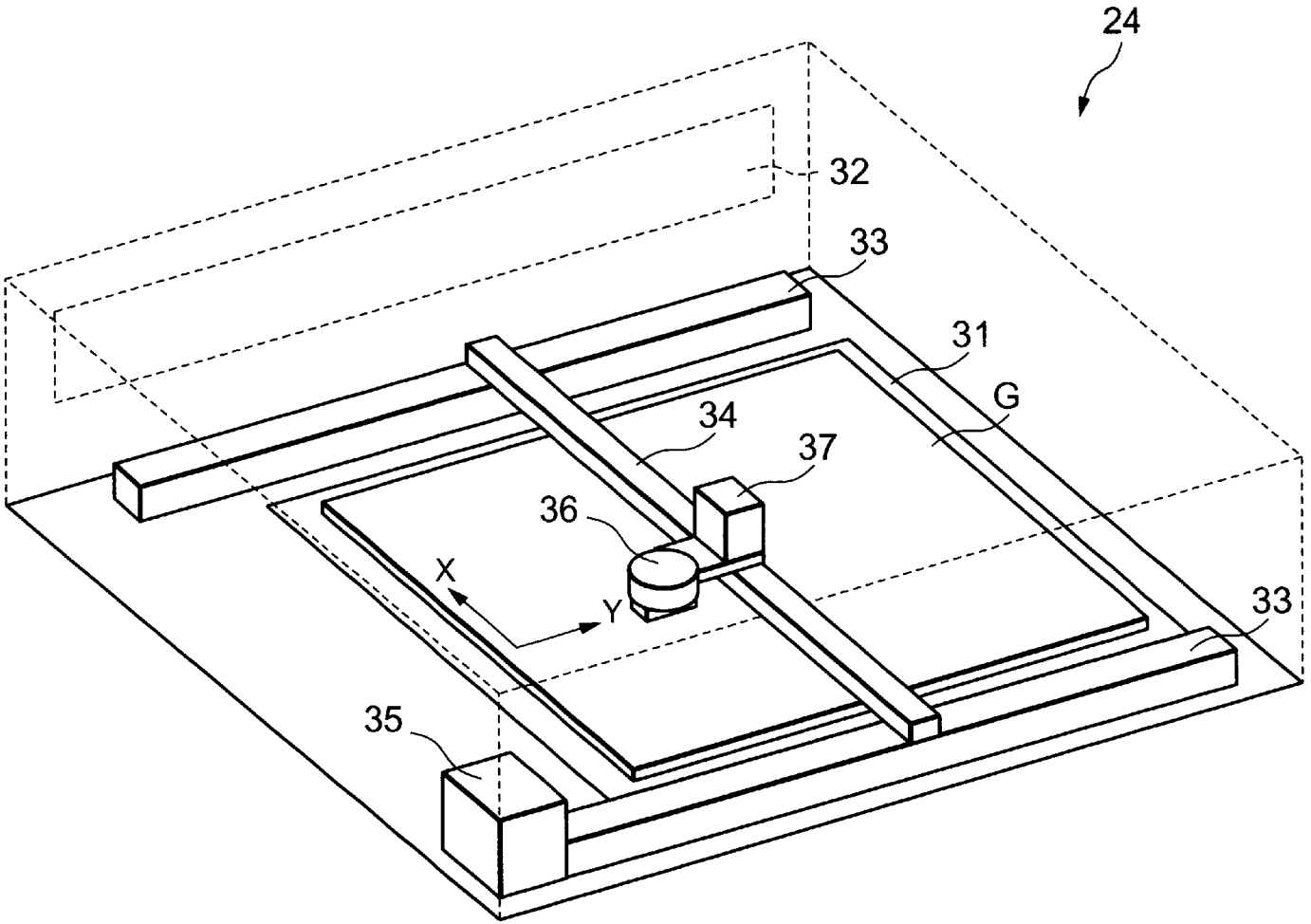
FIG. 2 is a perspective view showing a configuration of a coating apparatus in the coating and developing processing system shown in FIG. 1.

FIG. 2 is a perspective view showing the configuration of the coating device 24 described above.

A retainer plate 31 as a holding member for holding the substrate G is disposed in approximately a center of the coating device 24. A plurality of support pins (not illustrated) for supporting the substrate G are disposed on the retainer plate 31 to be able to protrude and retreat from its top surface. The substrate G is transferred from and to the main substrate transfer device 22 via an opening 32 of the coating device 24 with the support pins protruded from the top surface of the retainer plate 31. The coating processing is performed in a state in which the substrate G is placed on the retainer plate 31 with the support pins being retreated from the top surface of the retainer plate 31.

X direction transfer members 33 composed, for example, of an endless belt are disposed at both sides along the X direction of the coating device 24, and a Y direction transfer member 34 is disposed to cross an area between the X direction transfer member 33. A drive element 35 for driving the X direction transfer members 33 composed, for example, of an endless belt to transfer the Y direction transfer member 34 in the X direction is provided at one end of one of the X direction transfer members 33. A transfer element 37 for transferring a coating head 36 in the Y direction along the Y direction transfer member 34 is movably disposed on the Y direction transfer member 34. In this embodiment, the X direction transfer member 33, the Y direction transfer member 34, the drive element 35 and the transfer element 37 define a scanning mechanism according to the present invention.

Figure 3:
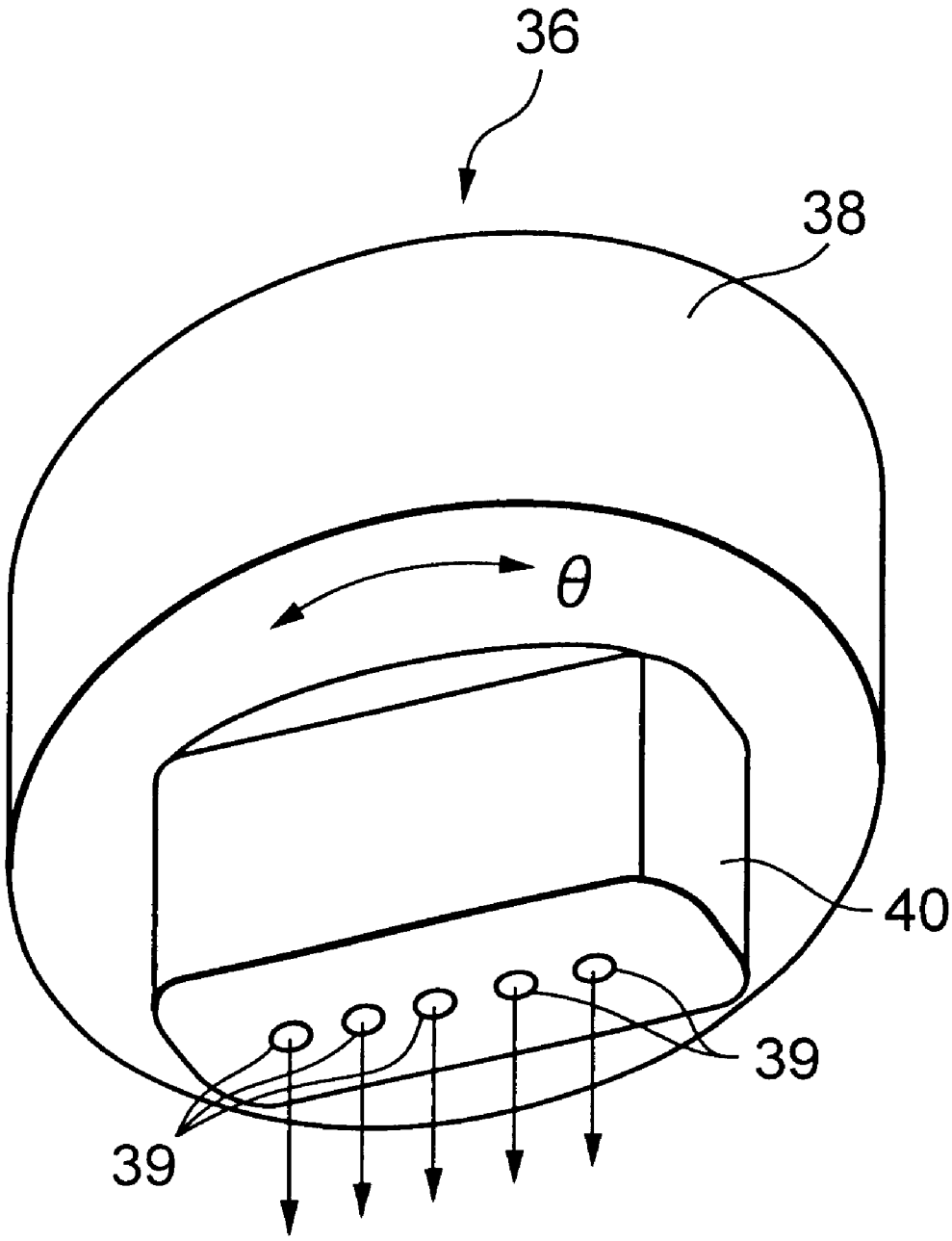
FIG. 3 is a perspective view showing a configuration of a coating head in the coating apparatus shown in FIG. 2.

FIG. 3 is a perspective view showing the configuration of the coating head 36 described above.

At a lower portion of a main body 38 of the coating head 36, provided is a nozzle 40, which is provided with a plurality of, for example, five discharge apertures 39 arranged in line for discharging the resist solution as a coating solution to the top surface of the substrate G held by the retainer plate 31. The resist solution is supplied to the nozzle 40 from a resist solution reservoir tank via a pump not illustrated. The nozzle 40 is rotated in a θ direction by a rotating mechanism included in the main body 38 as an angle adjusting mechanism according to the present invention. As for the rotating mechanism, for example, an air driving rotary actuator and a motor can be used. For example, two kinds of angles are previously set or the angle can be adjusted at will.

Next, the operation of the coating and developing system 1 configured as above will be explained.

After the unprocessed substrate G housed in the cassette 11 is taken out by the carry in/out tweezers 13 of the loader section 2, it is delivered to the main substrate transfer device 15 of the first processing section 3 and is transferred into the brush cleaning device 17. The substrate G, which is brush-cleaned in the brush cleaning device 17, undergoes hydrophobic processing in the adhesion processing device 19, and after it is cooled in the cooling processing device 21, it is placed on the junction section 4.

The main substrate transfer device 22 of the second processing section 5 receives the substrate G and transfers it to the coating device 24.

In the coating device 24, the support pins (not illustrated) receive the substrate G from the main substrate transfer device 22 in a state they are protruded from the top surface of the retainer plate 31, and they retreats from the top surface of the retainer plate 31 to thereby place the substrate G on the retainer plate 31.

Figure 4:
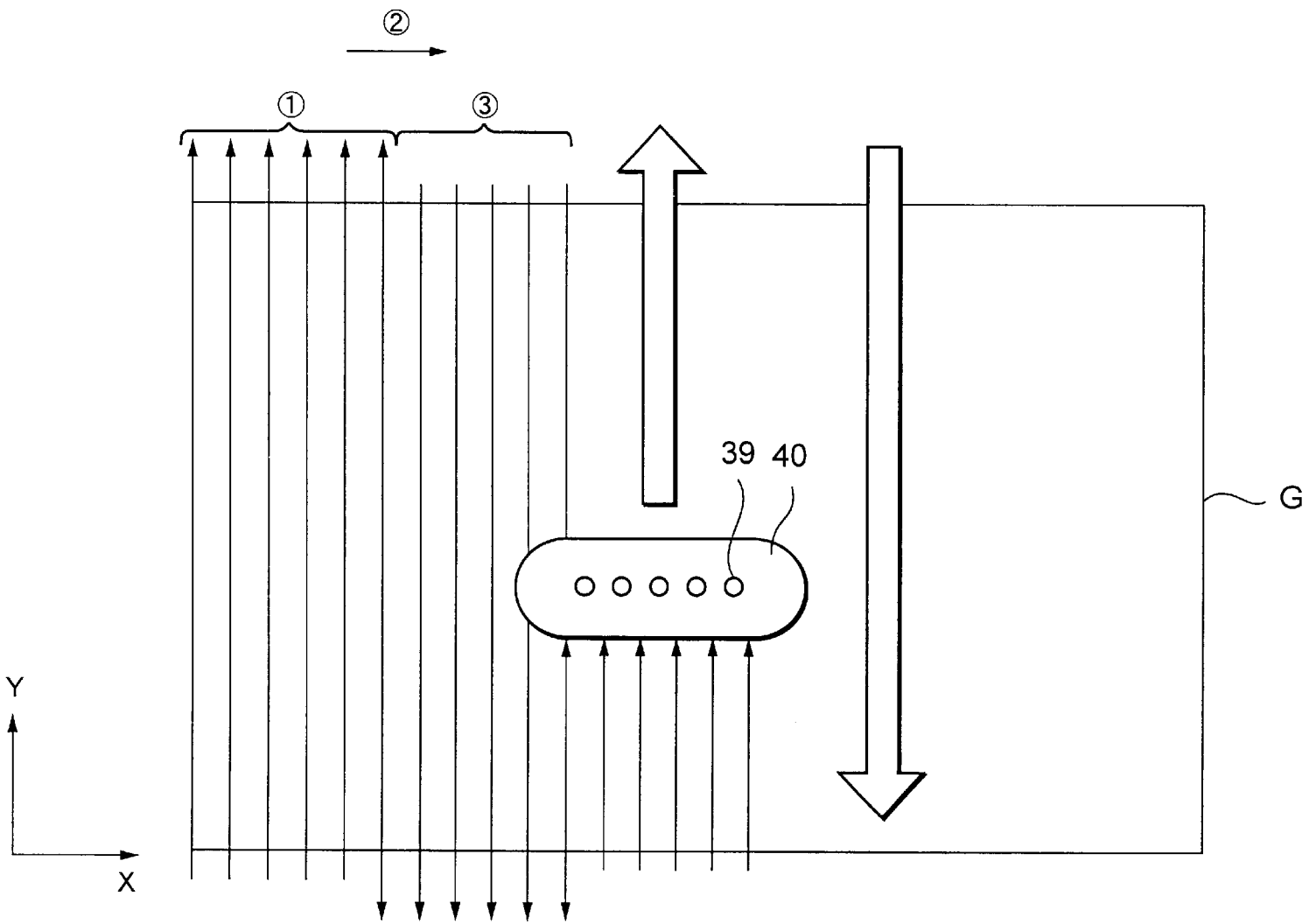
FIG. 4 is a schematic plan view showing a scan-moving example of a coating head shown in FIG. 2.

Next, while the coating head 36 is scan-moved by scanning of the scanning mechanism defined by the X direction transfer member 33, the Y direction transfer member 34, the driving element 35 and the transfer element 37, the resist solution is supplied to the top surface of the substrate G from each discharge aperture 39 of the nozzle 40. As an example of the above scanning, for example, as shown in FIG. 4, the angle θ of the nozzle 40 is adjusted by the rotation mechanism so that the arranging direction of the discharge apertures 39 of the nozzle 40 is parallel with the X direction, and the coating head 36 is transferred in the Y direction from one end side in the X direction of the substrate G by the scanning mechanism (① in FIG. 4).

Subsequently, the coating head 36 is moved by the coating pitch of the entire nozzle 40 in the X direction by the scanning mechanism (② in FIG. 4), and the coating head 36 is transferred in the Y direction by the scanning mechanism (③ in FIG. 4). By repeating the above scanning hereinafter, the coating head 36 is scan-moved over the entire top surface of the substrate G, and thereby the resist solution is applied to the entire top surface of the substrate G.

Figure 5:
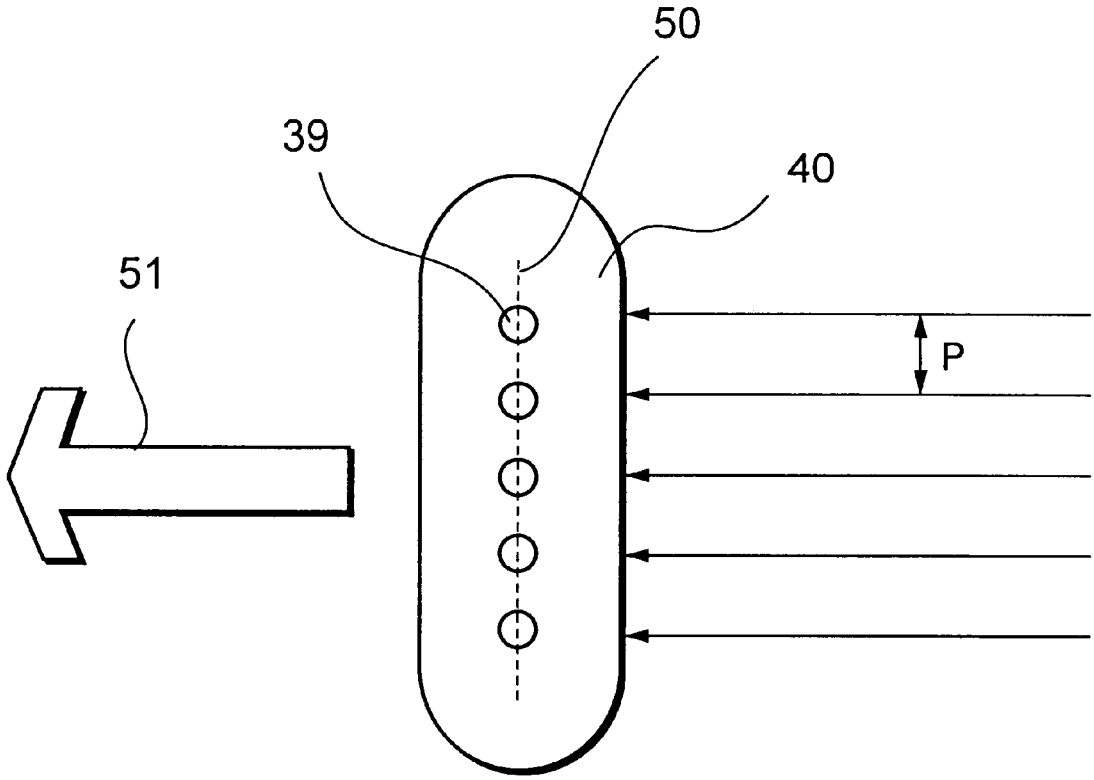
FIG. 5 is an explanatory view (no. 1) of a coating pitch in the coating head shown in FIG. 2.
Figure 6:
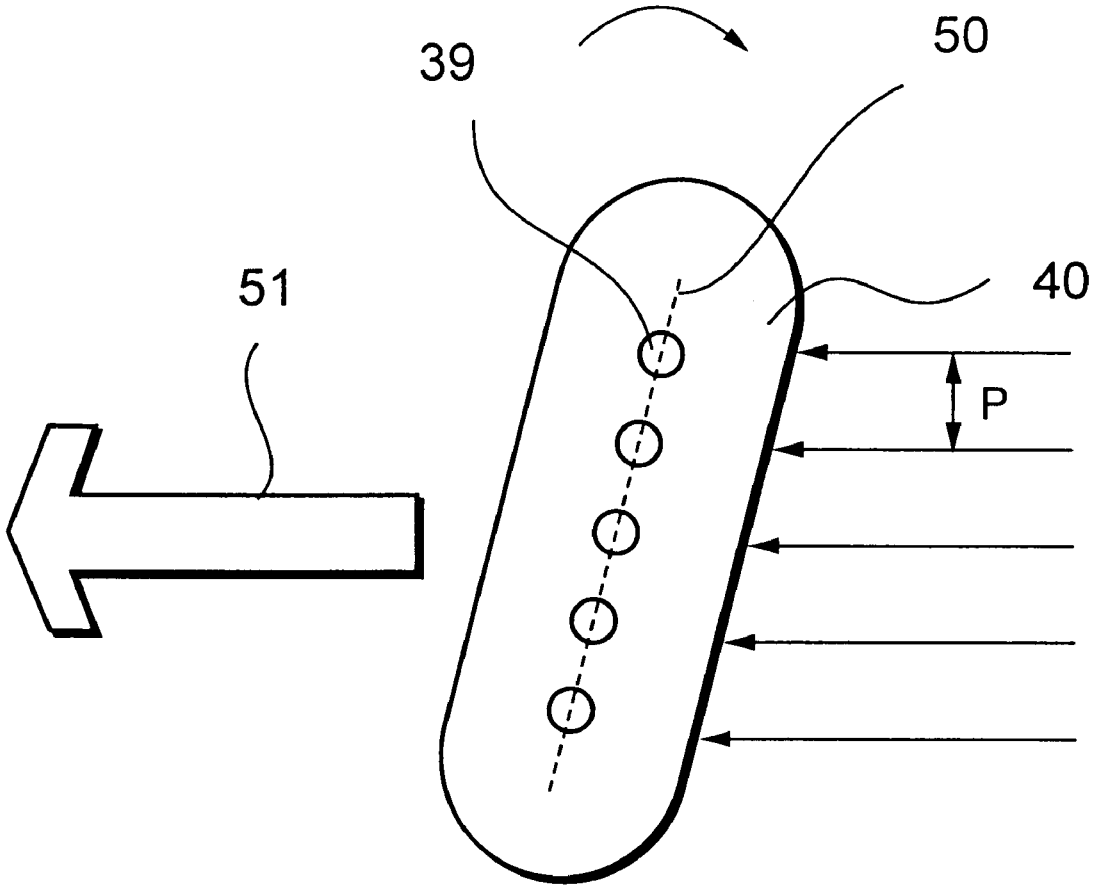
FIG. 6 is an explanatory view (no. 2) of the coating pitch in the coating head shown in FIG. 2.

In the above example, when the resist solution is applied onto the substrate G by the coating head 36, the angle θ of the nozzle 40 is adjusted by the rotation mechanism so that the arranging direction 50 of the discharge apertures 39 of the nozzle 40 is parallel (the direction orthogonal to a scanning direction 51) with the X direction, as shown in FIG. 5. As a result, a pitch P between the discharge apertures 39 adjacent to each other relative to the scanning direction 51 can be made maximum, and rapid coating processing can be performed. However, when the viscosity of the resist solution is high, or when the contact angle of the glass substrate top surface is large, the resist solutions discharged from the discharge apertures 39 adjacent to each other in the nozzle 40 are not in contact with each other, or a concave portion occurs in the contacting portion, and sometimes the resist solution cannot be applied uniformly. Thus in this embodiment, as shown in FIG. 6, the nozzle 40 is rotated by the rotation mechanism and a fixed angle is given between the arranging direction 50 of the discharge apertures 39 of the nozzle 40 and the scanning direction 51, thereby making it possible to reduce the pitch P between the discharge apertures 39 adjacent to each other relative to the scanning direction 51. Accordingly, in this embodiment, the pitch P between the discharge apertures 39 adjacent to each other can be adjusted only by providing the rotation mechanism, thereby making it possible to uniformly applying the resist solution onto the substrate G.

Figure 12:
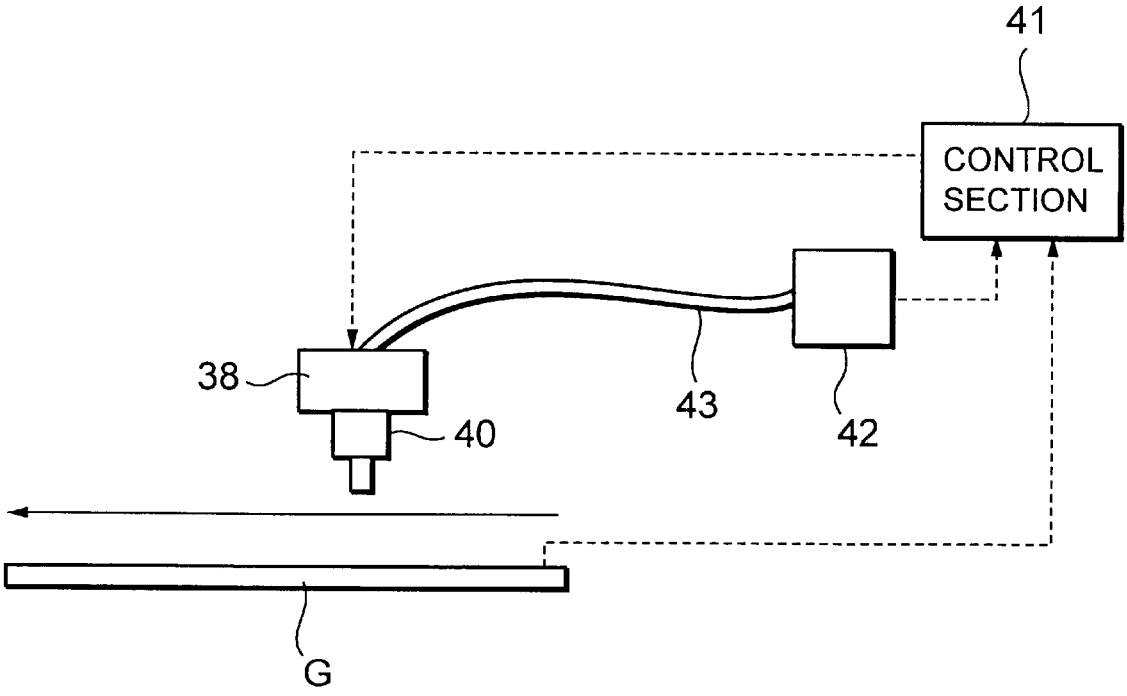
FIGS. 12 is a schematic side view of the coating apparatus according to first embodiment.

The adjustment of the angle of the nozzle 40 can be automated, for example, by providing a controller as describe below. Specifically, as shown in FIG. 12, the angle adjustment can be automated by providing a resist solution supply pipe 43 for supplying the resist solution inside the resist solution tank 42 into the nozzle 40 and a controller 41 into which viscosity data of the resist solution and contact angle data of the substrate G are inputted, which calculates the angle made by the scanning direction 51 of the nozzle and the arranging direction 50 of the discharge apertures based on the information, and which adjusts the angle of the nozzle 40 by the rotation mechanism based on the calculation result. Further, in the controller 41, based on the information of the viscosity data and the contact angle data of the substrate G, a scanning speed of the nozzle which provides a desired film thickness of the resist film is calculated and based on the calculation result, the scanning speed may be adjusted. Thereby, even if the film thickness of the resist film differs according to the variation of the pitch P between the discharge apertures 39, the resist film with a desired film thickness can be obtained by adjusting the scanning speed. Further, in the controller 41, based on the information of the viscosity data and the contact angle data of the substrate G, the discharge pressure of the resist solution discharged from the discharge apertures, which gives the resist film a desire film thickness is calculated, and the discharge pressure may be adjusted based on the calculation result. Thereby, even if the film thickness of the resist film differs according to the variation of the pitch P between the discharge apertures 39, the resist film with a desired film thickness can be obtained by adjusting the discharge pressure. Further, for example, contact angle data or the like and the angle made by the arranging direction 50 of the discharge apertures corresponding to them may be previously obtained by an experiment, and may be memorized in the controller as information.

The substrate G coated with the resist solution by the processing described above is heated in the heat processing device 20 to thereby undergo the baking processing, and after it is cooled in the cooling processing device 21, a predetermined pattern is exposed in the aligner 6. The substrate G after exposure is transferred into the developing device 18, and after it is developed by a developing solution, the developing solution is washed off by a rinse solution, thereby completing the developing processing. Thereafter, it is heated in the heat processing device 20 to have the baking processing applied thereto, and after it is cooled in the cooling processing device 21, the processed substrate G is housed in the cassette 12 of the loader section 2, thereby finishing a series of processing.

According to the coating device 24 in the coating and developing processing system 1 according to the present invention, the resist solution is simultaneously discharged from a plurality of discharge apertures 39, while, for example, the nozzle 40 is scan-moved in a direction orthogonal to the arranging direction 50 of the discharge apertures 39, thereby making it possible to apply the resist solution onto the substrate G with approximately the width of the discharge apertures 39 arranged in line relative to the scanning direction of the nozzle 40. Accordingly, the waste of the resist solution is eliminated, and the time taken to perform resist-coating processing can be reduced. Further, since the radius does not have to be made large as for each discharge aperture 39, the resist solution does not drop.

Next, a second embodiment of the present invention will be explained.

Figure 7:
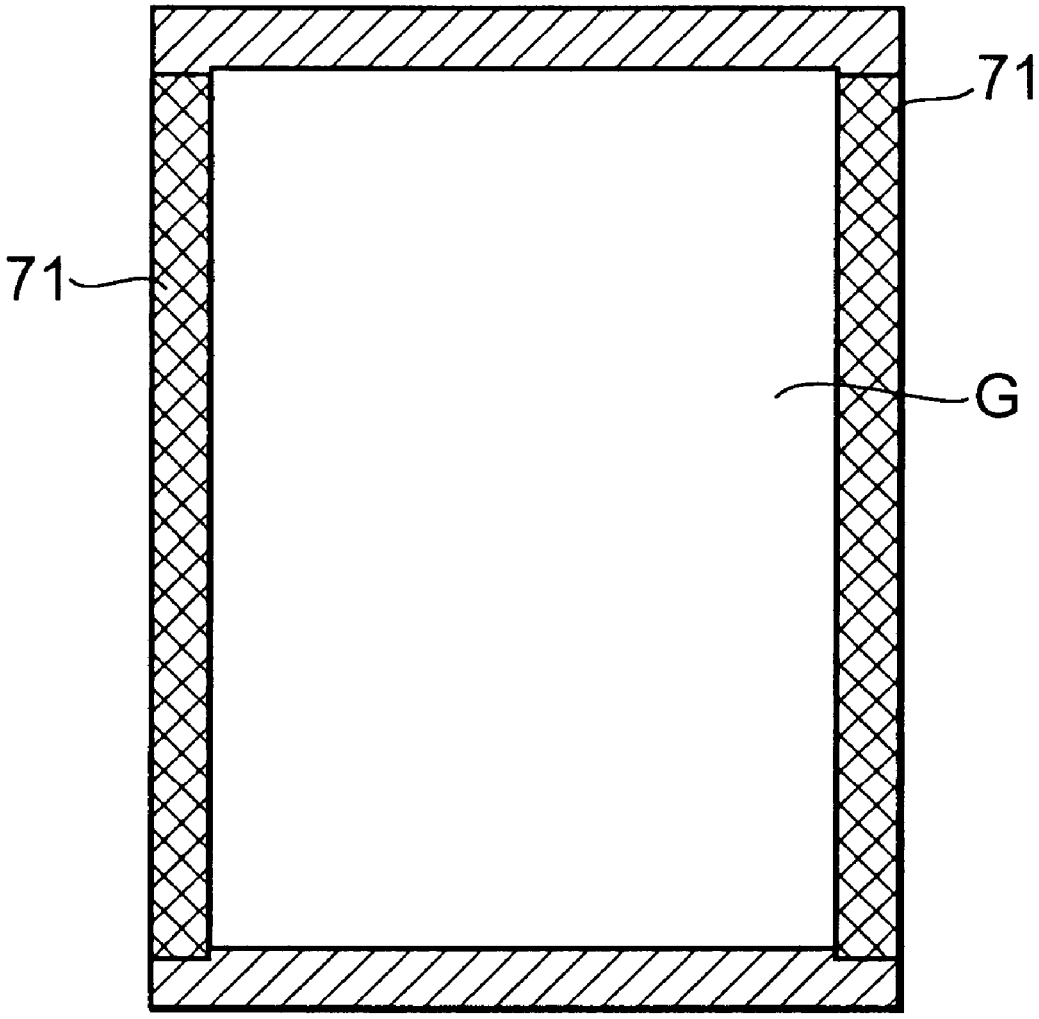
FIG. 7 is an explanatory view according to a second embodiment.
Figure 8:
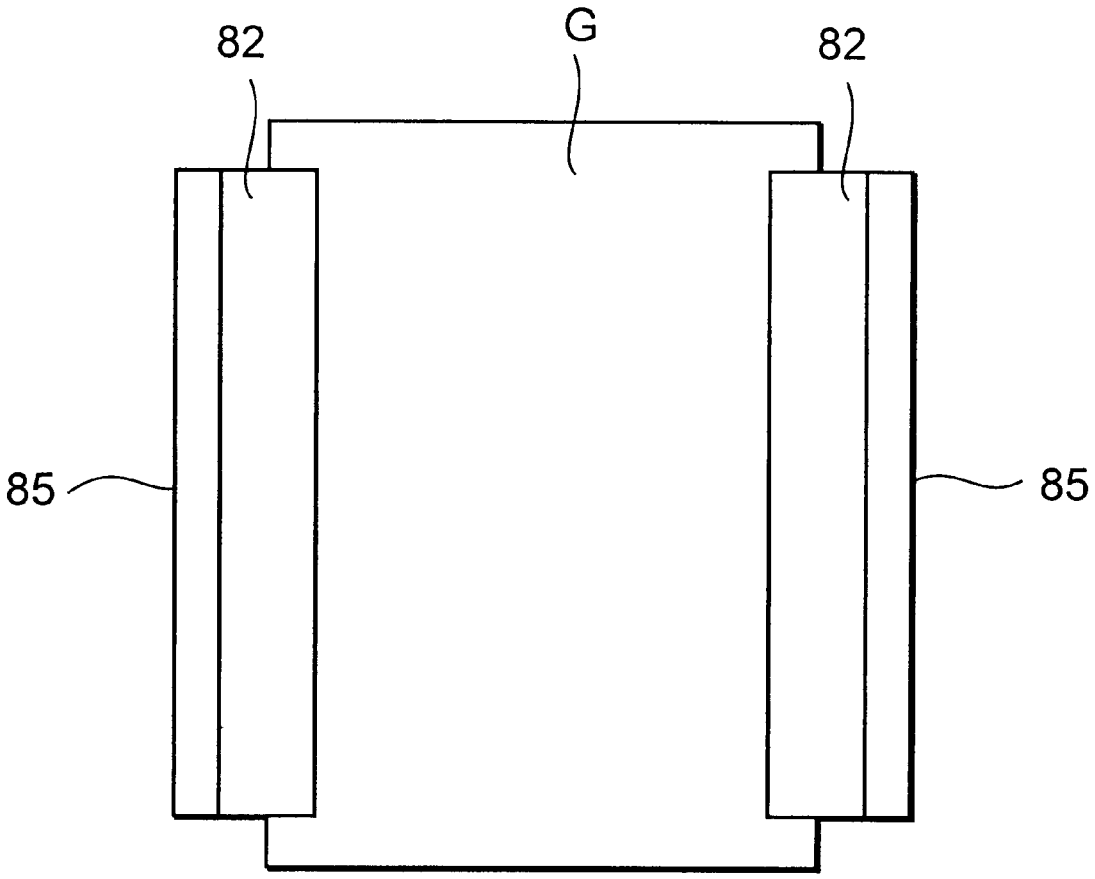
FIG. 8 is a plan view of a coating apparatus according to the second embodiment.

In some cases, the resist solution is not applied onto the entire top surface of the substrate G and as shown by the oblique lines in FIG. 7, the outer edge portion of the substrate G does not require the resist solution coating. In the second embodiment, in such cases, a shielding member 82 is interposed between the substrate G and the nozzle 40 at an overlap area 71 (the portion shaded by the left and right crossed lines) on which the coating forbidden area for the resist solution on the top surface of the substrate G and the scanning area on which the nozzle is scan-moved overlap. The above shield member 82 prevents the resist solution from being applied from the nozzle 40 to the resist solution coating forbidden area on the substrate G, for example, the outer edge portion of the substrate G, thus making it unnecessary to perform end portion processing and the like to remove the resist solution at the end portions after the resist solution is applied onto the entire top surface of the substrate G.

Further, in the second embodiment, the shield member 82 has an inclined plane 83 inclining downward with extending toward the outside of the substrate G. Thereby, unnecessary resist solution does not drop onto the substrate G from the shield member 82.

Figure 10:
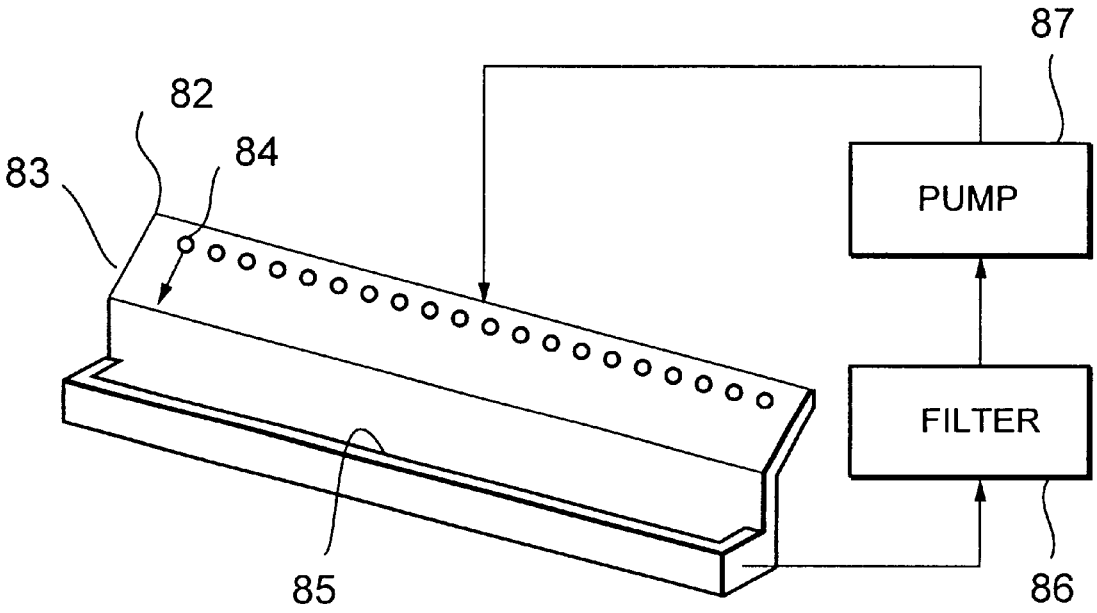
FIG. 10 is a perspective view of the coating apparatus shown in FIG. 8.

Further, in the second embodiment, as shown in FIG. 10, as the means for feeding the cleaning solution toward the lower portion from the upper portion of the inclined plane 83 of the shield member 82, a number of cleaning solution discharging apertures 84 are provided in the upper portion of the inclined plane 83. A recapturing path 85 for the cleaning solution is provided along the end side of the inclined plane 83. The cleaning solution recaptured by the recapturing path 85 is fed to the cleaning solution discharge apertures 84 via a filter 86 and a pump 87 and can be reused as a cleaning solution.

In the second embodiment, with the above configuration, the resist solution is not attached to the inclined plane 83 and further the cleaning solution for this is not wasted. The cleaning solution may be discharged to only the area above that the nozzle 40 passes and the cleaning solution discharging range may be sequentially switched. Thus, the amount of the cleaning solution to be used can be reduced, and filtering processing for the cleaning solution by means of the filter 86 is lessened.

Figure 9:
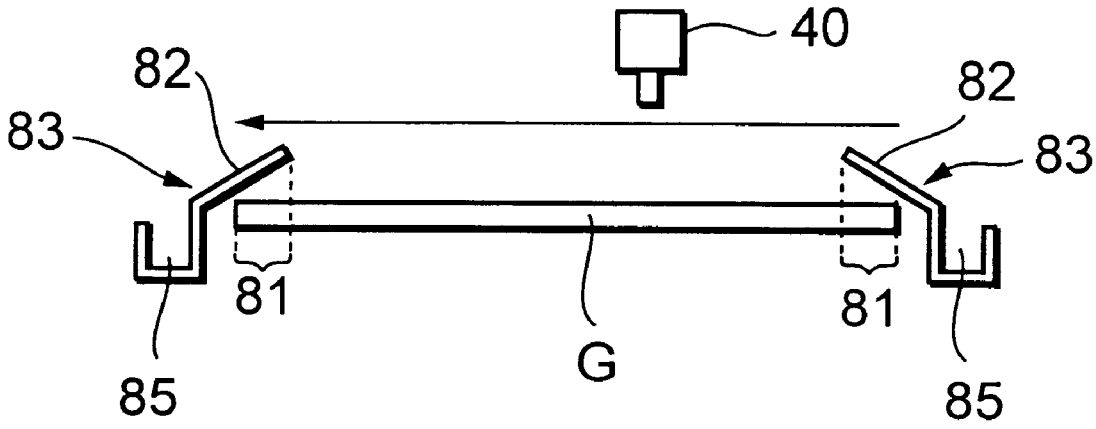
FIG. 9 is a side view of the coating apparatus shown in FIG. 8.
Figure 11:
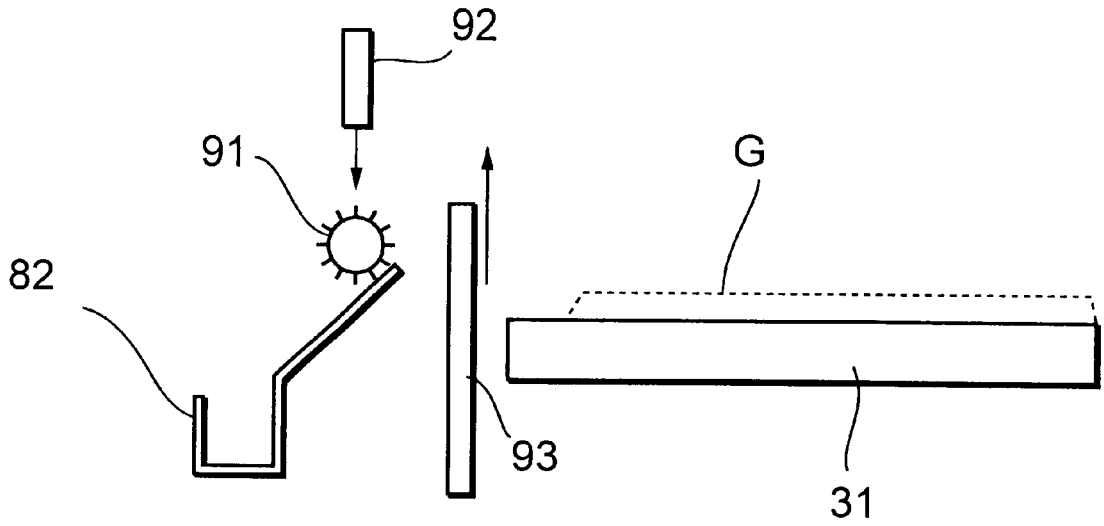
FIG. 11 is a side view of a coating apparatus according to a third embodiment.

As shown in FIG. 9, each shield member 82 is designed to be movable leftward and rightward, and as shown in FIG. 10, the cleaning solution is always discharged from the cleaning solution discharge apertures 84. However, as a third embodiment, as shown in FIG. 11, the shield member 82 may be designed to be movable leftward and rightward, for example, when the glass substrate G is replaced. A brush 91 previously disposed may be designed to abut to the shield member 82, when the shield member 82 moves to the position to avoid the glass substrate G at the time of the replacement of the glass substrate G. The brush 91 may be designed to rotate by a motor not illustrated while the cleaning solution is supplied to the brush 91 and the shield member 82 from an auxiliary cleaning solution supply nozzle 92 disposed above the brush 91 to thereby remove the resist attached to the shield member 82. It is further preferable that a shield plate 93 is designed to rise, for example, from below between the shield member 82 and the retainer plate 31 for holding the glass substrate G to shield the space between the shield member 82 and the retainer plate 31 for holding the glass substrate G when the shield member 82 moves to the position to avoid the glass substrate G at the time of cleaning, thereby preventing the cleaning solution splashed out of the auxiliary cleaning mechanism from attaching to the retainer plate 31. According to the above embodiment, it becomes possible to remove the resist attached to the upper portion extending from the cleaning solution discharge apertures of the shield member 82.

Figure 13:
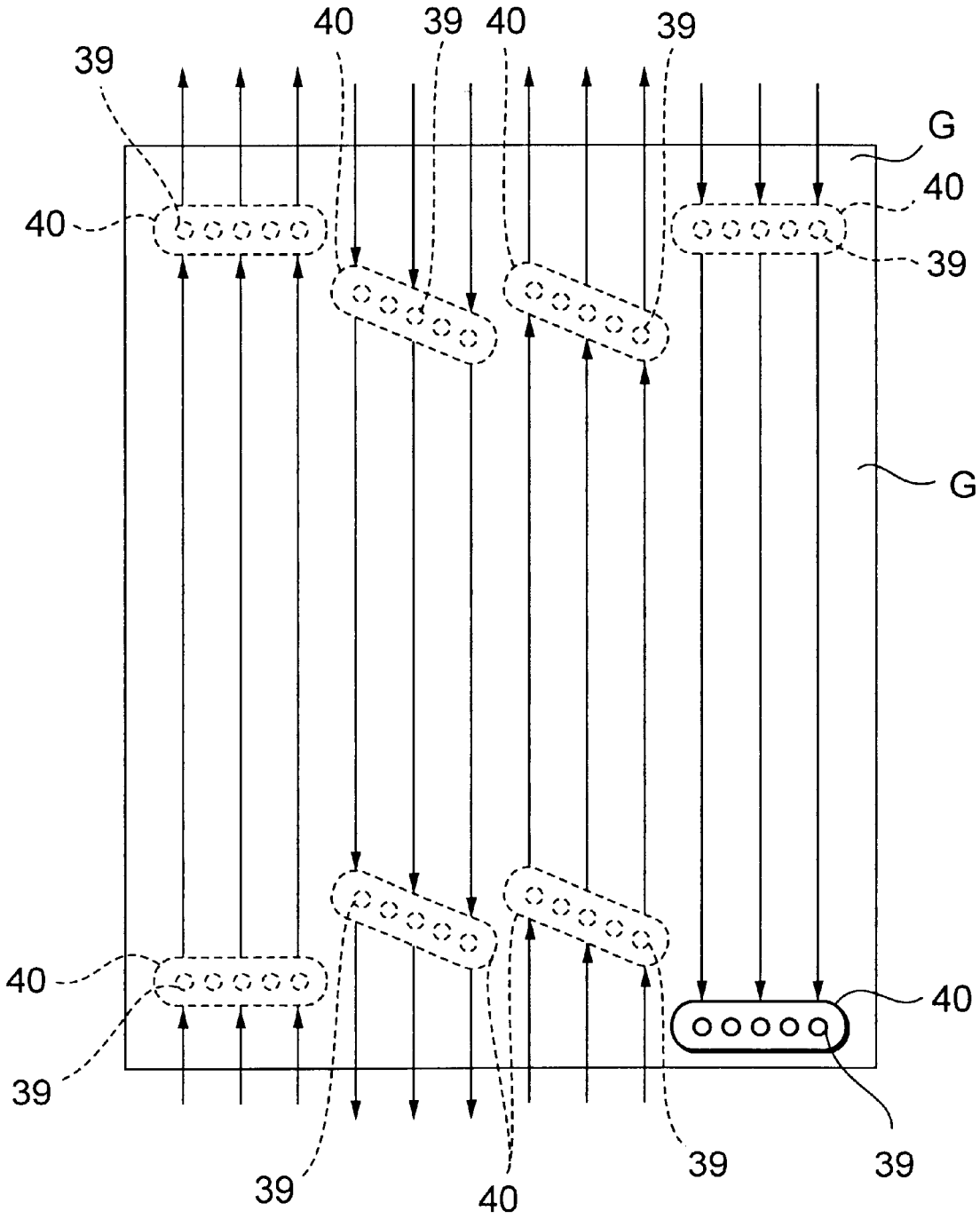
FIG. 13 is a schematic plan view showing a scan-moving example of a coating head according to a fourth embodiment.

In this situation, when the resist film is applied, the film thickness near the end portions is sometimes larger than the film thickness in the center portion. In such a case, as a fourth embodiment, as shown in FIG. 13, scanning may be carried out with the angle of the nozzle 40 being changed according to the areas within the same plane. Specifically, when it is scan-moved along the areas near the end portion of the substrate, the nozzle 40 is positioned so that the arranging direction of the discharge apertures provided in line in the nozzle 40 and the scanning direction of the nozzle 40 form a right angle. When it is scan-moved over the center portion of the substrate, the nozzle 40 may be positioned so that the arranging direction of the discharge apertures provided in line in the nozzle 40 and the scanning direction of the nozzle 40 make an acute angle. Thus, the pitch P between the discharge apertures 39 above the end portions of the substrate G becomes larger than the pitch P between the discharge apertures 39 above the center portion of the substrate G. Consequently, the nozzle 40 is always scan-moved at the same discharge pressure and at the same scanning speed within the substrate plane, thereby making it possible to form the resist film with approximately uniform film thickness within the substrate plane. Coating is performed by the nozzle 40 scan-moving with the different pitches P according to the areas within the same plane, thus making it possible to uniformly form the resist film within the plane without changing the scanning speed of the nozzle 40 or the discharge pressure of the resist solution.

The present invention is not limited to the aforementioned embodiments. For example, the substrate is not limited to a glass substrate, but may be a semiconductor wafer and the like.

As explained thus far, according to the present invention, the disadvantage of the coating solution dropping or the like is eliminated, waste of the coating solution is avoided, and the time taken to perform coating processing can be reduced.

The disclosure of Japanese Patent Application No. 11-281719 filed Oct. 1, 1999 including specification, drawings and claims are herein incorporated by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A coating apparatus, comprising:

a holding member for holding a substrate;

a nozzle provided with a plurality of discharge apertures in line for discharging a coating solution toward a top surface of the held substrate;

a scanning mechanism for scan-moving said nozzle over the held substrate, an angle adjusting mechanism for adjusting an angle which is formed by a scanning direction of the nozzle scan-moved by said scanning mechanism and an arranging direction of the discharge apertures provided in line in said nozzle;

means for inputting at least viscosity data of the coating solution and contact angle data of the substrate top surface; and means for calculating the angle formed by the scanning direction of said nozzle and the arranging direction of said discharge apertures based on the input data and adjusting the angle by means of said angle adjusting mechanism based on the calculation result.

2. The coating apparatus as set forth in claim 1, further comprising:

means for calculating discharge pressure of the coating solution discharged from said discharge apertures based on the input data.

3. The coating apparatus as set forth in claim 1, further comprising:

means for calculating the scanning speed of said nozzle based on the input data.

4. The coating apparatus as set forth in claim 1, further comprising:

a shield member interposed between the substrate and said nozzle above an overlap area in which a coating forbidden area for the coating solution on the substrate top surface and a scanning area over which said nozzle is scan-moved are overlapped.

5. The coating apparatus as set forth in claim 4, wherein said shield member has an inclined plane which inclines downward as it extends toward an outside of the substrate.

6. The coating apparatus as set forth in claim 5, further comprising:

means for feeding a cleaning solution from an upper portion to a lower portion of the inclined plane of said shield member.

7. The coating apparatus as set forth in claim 6, further comprising:

a recapturing path for the cleaning solution, which is provided along an end side of the inclined plane extending toward the outside of the substrate; and means for filtering the cleaning solution recaptured by said recapturing path to reuse the same.

8. The coating apparatus as set forth in claim 1, wherein said nozzle is scan-moved with the angle being changed by said angle adjusting mechanism within the same plane of the substrate.

9. A The coating apparatus as set forth in claim 8, wherein the angle of said nozzle at the time of scan-moving over end portions of the substrate and the angle of said nozzle at the time of scan-moving over a center portion of the substrate differ.

10. A coating apparatus, comprising:

a holding member for holding a substrate;

a nozzle provided with a plurality of discharge apertures in line for discharging a coating solution toward a top surface of the held substrate;

a scanning mechanism for scan-moving said nozzle over the held substrate; and a shield member interposed between the substrate and said nozzle above an overlap area in which a coating forbidden area for the coating solution on the substrate top surface and a scanning area over which said nozzle is scan-moved are overlapped.

11. The coating apparatus as set forth in claim 10, wherein said shield member has an inclined plane which inclines downward as it extends toward an outside of the substrate.

12. The coating apparatus as set forth in claim 11, further comprising:

means for feeding a cleaning solution from an upper portion to a lower portion of the inclined plane of said shield member.

13. A coating apparatus, comprising:

a holding member for holding a substrate;

a nozzle provided with a plurality of discharge apertures in line for discharging a coating solution toward a top surface of the held substrate;

a scanning mechanism for scan-moving said nozzle over the held substrate; and an angle adjusting mechanism for adjusting an angle which is formed by a scanning direction of the nozzle scan-moved by said scanning mechanism and an arranging direction of the discharge apertures provided in line in said nozzle.

* * * * *